US012790064B2

(12) United States Patent
Kastelic et al.

(10) Patent No.: US 12,790,064 B2
(45) Date of Patent: Nov. 10, 2026

(54) BAKERY TRAY

(71) Applicant: SPF Groups, Byron, GA (US)

(72) Inventors: Alexander Ross Kastelic, Costa Mesa, CA (US); Jordon Drake Hale, Macon, GA (US)

(73) Assignee: SPF Groups, Byron, GA (US)

( * ) Notice: Subject to any disclaimer, the term of this patent is extended or adjusted under 35 U.S.C. 154(b) by 62 days.

(21) Appl. No.: 18/540,142

(22) Filed: Dec. 14, 2023

(65) Prior Publication Data

US 2024/0208688 A1 Jun. 27, 2024

Related U.S. Application Data

(60) Provisional application No. 63/434,248, filed on Dec. 21, 2022.

(51) Int. Cl.
*B65D 1/34* (2006.01)
*B65D 21/02* (2006.01)

(52) U.S. Cl.
CPC ..... *B65D 1/34* (2013.01); *B65D 21/0212* (2013.01)

(58) Field of Classification Search
CPC ... B65D 1/34; B65D 21/0212; B65D 21/0233
USPC ..... 206/499, 505, 515, 551, 557; 211/126.7, 211/126.8; 220/485, 491, 493, 573.1, 220/573.4, 573.5, 668
See application file for complete search history.

(56) References Cited

U.S. PATENT DOCUMENTS

| | | | | |
|---|---|---|---|---|
| 2,704,974 | A * | 3/1955 | Setman | A47G 23/06 99/422 |
| 3,120,323 | A * | 2/1964 | Sparling | B65D 21/048 206/505 |
| 3,870,151 | A | 3/1975 | Johnson | |
| D239,691 | S | 4/1976 | Ashton | |
| D244,486 | S | 5/1977 | Johnson et al. | |
| D247,652 | S | 3/1978 | Carroll et al. | |
| D258,212 | S | 2/1981 | Negrete | |
| 5,575,390 | A | 11/1996 | Apps et al. | |
| D378,561 | S | 3/1997 | Ferris et al. | |
| 7,784,615 | B2 * | 8/2010 | Stahl | B65D 21/045 206/511 |

(Continued)

OTHER PUBLICATIONS

Https://www.amazon.com/HUBERT-Commercial-Display-Basket-Rectangular/dp/B01DCB5TP4, "HUBERT® Wire Display Basket Rectangular Chrome Plated Pastry Basket Bakery Tray—26"L × 18"W × 2"H", accessed on Dec. 8, 2022, (6 pages).

(Continued)

*Primary Examiner* — Luan K Bui
(74) *Attorney, Agent, or Firm* — Brooks Kushman P.C.

(57) ABSTRACT

A bakery tray includes a base including a top surface and a bottom surface, the top surface including a plurality of nesting tabs extending upwardly therefrom. A wall structure extends upwardly from a periphery of the base and includes an inner surface and an outer surface. The wall structure includes an upper rim having a uniform height above the base, the wall structure having a mesh configuration. The base and the wall structure are integrally formed from a plastic material, and the plurality of nesting tabs are configured to support another bakery tray nested within the bakery tray.

6 Claims, 11 Drawing Sheets

(56) References Cited

U.S. PATENT DOCUMENTS

| | | | | |
|---|---|---|---|---|
| 8,141,737 | B1 * | 3/2012 | Tsai | B65D 7/14 220/493 |
| D667,681 | S | 9/2012 | Carsten | |
| 9,174,769 | B1 * | 11/2015 | Zephir | D06F 95/002 |
| D876,093 | S | 2/2020 | Thompson | |
| D1,013,457 | S | 2/2024 | Cabrera et al. | |
| 12,129,091 | B2 * | 10/2024 | Nilsson | B21D 5/00 |
| 2005/0067315 | A1 * | 3/2005 | Masello | A01G 9/021 206/515 |
| 2006/0180491 | A1 * | 8/2006 | Zephir | B65D 21/046 206/507 |
| 2009/0025248 | A1 * | 1/2009 | Lannon | F26B 25/18 34/195 |

OTHER PUBLICATIONS

Https://www.tigerchef.com/winco-db-1218-doughnut-basket.html?mkwid=_dc&pcrid=&pkw=&pmt=&plc=&gclid=Cj0KCQiAx6ugBhCcARIsAGNmMbh3_FkgX-zdOc3xYIUEV_i57jCStnBOvlmWAUO1B0z9MzKeywmhRW8aArW8EALw_wcB, "Winco DB-1218 Doughnut Basket 12" × 18" × 2" TigerChef", accessed on Dec. 8, 2022, (3 pages).

Https://www.webstaurantstore.com/choice-26-x-16-x-2-wire-bagel-pastry-basket/176WSBB1626.html?utm_source=google&utm_medium=cpc&utm_campaign=GoogleShopping&gclid=Cj0KCQiApKagBhC1ARIsAFc7Mc4V7Y0MN2vpcBlQ6-QhuBSXvXb4etbdL7QvcJcHEfaeZ-tMmswTWx4aAqqAEALw_wcB, "Choice 26" x 16" x 2" Wire Bagel / Pastry Basket", accessed on Dec. 8, 2022, (9 pages).

Https://www.invictabakeware.co.uk/plastics/bakery-trays/765-x-455-range/20-litre-bakery-tray-with-mesh-base-and-mesh-sides-765mm-x-455mm-range/, 20-litre Bakery Tray with Mesh Base and Mesh Sides—765 mm × 455 mm Range—765 × 455 range—Invicta Bakeware, accessed on Dec. 8, 2022, (5 pages).

* cited by examiner

BAKERY TRAY

CROSS-REFERENCE TO RELATED APPLICATIONS

This application claims the benefit of U.S. provisional application Ser. No. 63/434,248 filed Dec. 21, 2022, the disclosure of which is hereby incorporated in its entirety by reference herein.

TECHNICAL FIELD

Embodiments relate to a bakery tray, such as for storing, displaying, and/or transporting baked goods.

BACKGROUND

Bakery trays are commonly used to store, transport, and display a variety of baked goods. Such trays are typically made of metals like stainless steel or aluminum formed in a grid or mesh pattern of wires. While this structure allows for air circulation and visibility of the tray contents, sharp metal edges at joint areas of the mesh can result in cuts, scrapes, or other injuries during handling. Convention metal wire bakery trays may also be prone to rust or galvanized flaking, which could cause contamination of the baked goods stored therein. Metal trays may also be costly, heavy, and difficult to clean.

SUMMARY

In one or more embodiments, a bakery tray includes a base including a top surface and a bottom surface, the top surface including a plurality of nesting tabs extending upwardly therefrom. A wall structure extends upwardly from a periphery of the base and includes an inner surface and an outer surface. The wall structure includes an upper rim having a uniform height above the base, the wall structure having a mesh configuration. The base and the wall structure are integrally formed from a plastic material, and the plurality of nesting tabs are configured to support another bakery tray nested within the bakery tray.

In one or more embodiments, the plurality of nesting tabs includes central tabs which are spaced along a central transverse axis of the base. In one or more embodiments, the plurality of nesting tabs includes edge tabs projecting upwardly from the base at each corner of the bakery tray and at each end of the central transverse axis. In one or more embodiments, the plurality of nesting tabs each have a height of between about 0.35 to about 0.4 inches above the top surface of the base.

In one or more embodiments, a height of the wall structure from the base to the upper rim is between about 2.5 inches and about 3 inches. In one or more embodiments, the mesh configuration of the wall structure includes longitudinal and transverse struts which define openings, wherein each opening has an area of approximately 1 in2. In one or more embodiments, the wall structure flares outwardly from the base such that a perimeter of the upper rim is larger than a perimeter of the base. In one or more embodiments, the top surface, the bottom surface, the inner surface, and the outer surface each have a radiused configuration. In one or more embodiments, the inner surface of the wall structure is rounded adjacent to corners of the bakery tray.

In one or more embodiments, a bakery tray includes a generally rectangular base including a top surface and a bottom surface, the top surface including a plurality of nesting tabs extending upwardly therefrom including central tabs projecting upwardly along a central transverse axis of the base, and edge tabs projecting upwardly from the base at each corner of the bakery tray and at each end of the central transverse axis. A wall structure extends upwardly from a periphery of the base and includes an inner surface and an outer surface, the wall structure including an upper rim having a uniform height above the base. The wall structure flares outwardly from the base such that a perimeter of the upper rim is larger than a perimeter of the base, the wall structure having a mesh configuration including longitudinal and transverse struts which define openings The base and the wall structure are integrally formed from a plastic material, and the plurality of nesting tabs are configured to support another bakery tray nested within the bakery tray.

In one or more embodiments, a system of nesting bakery trays includes a first bakery tray including a first base including a top surface, the top surface including a plurality of nesting tabs extending upwardly therefrom, and a first wall structure extending upwardly from a periphery of the first base, the first wall structure including a first upper rim having a uniform height above the first base, the first wall structure having a mesh configuration, the first base and first the wall structure integrally formed from a plastic material. The system further includes a second bakery tray including a second base including a bottom surface, and a second wall structure extending upwardly from a periphery of the second base, the second wall structure including a second upper rim having a uniform height above the second base, the second wall structure having a mesh configuration, the second base and the second wall structure integrally formed from a plastic material. The second bakery tray is configured to be nested within the first bakery tray with the plurality of nesting tabs supporting the bottom surface of the second base such that the second upper rim of the second bakery tray is disposed above the first upper rim of the first bakery tray when nested.

DETAILED DESCRIPTION

Figure 1:
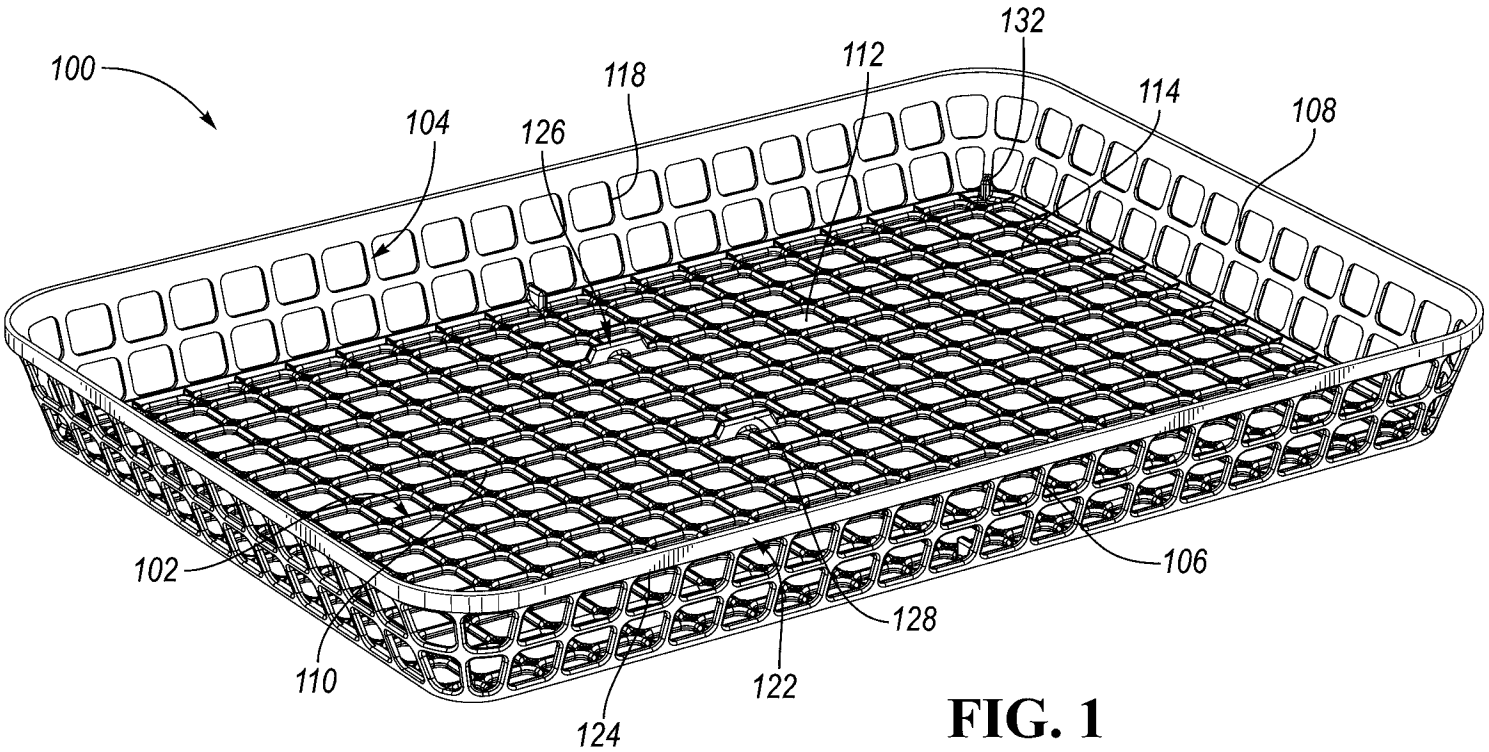
FIG. 1 is a top perspective view of a bakery tray according to one or more embodiments.
Figure 2:
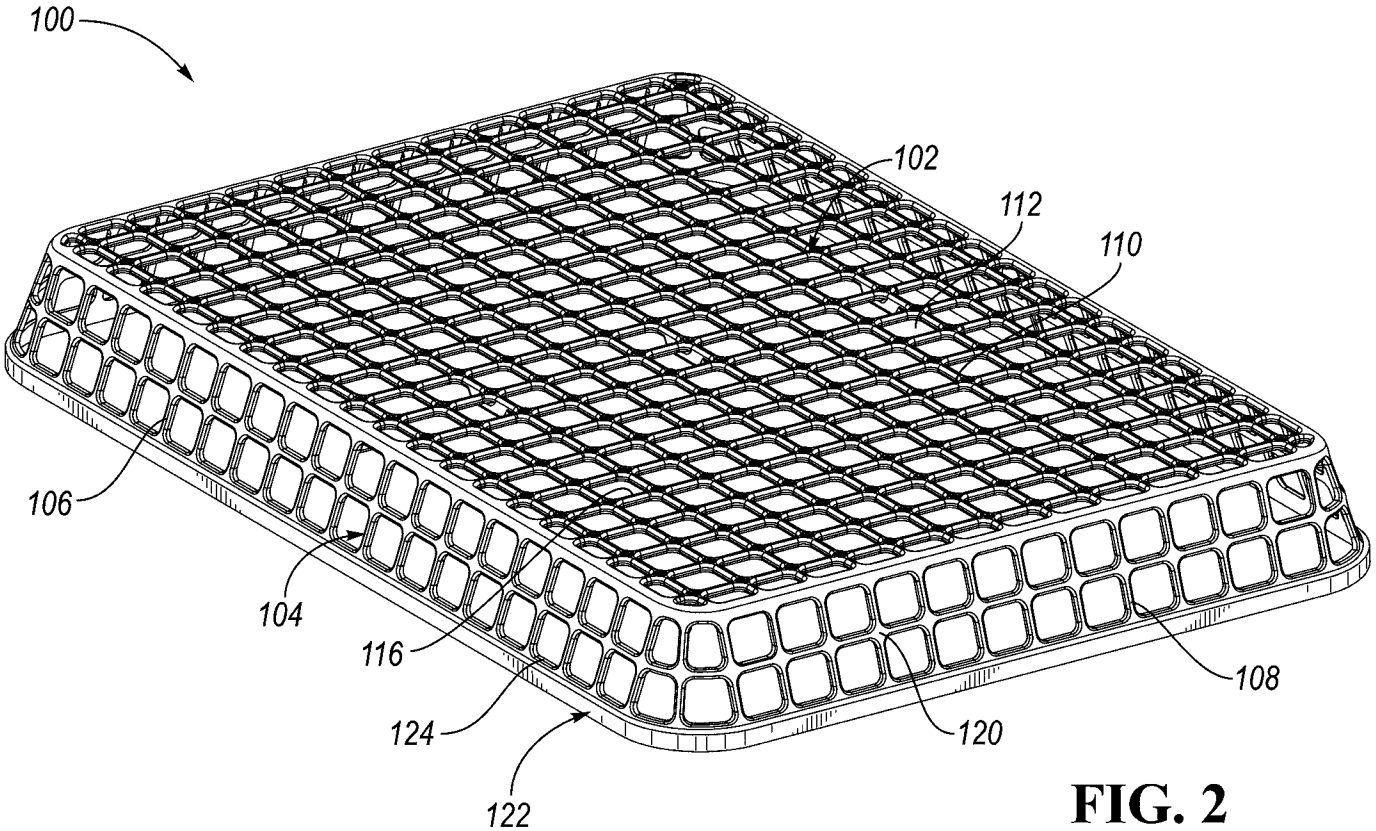
FIG. 2 is a bottom perspective view of the bakery tray.
Figure 3:
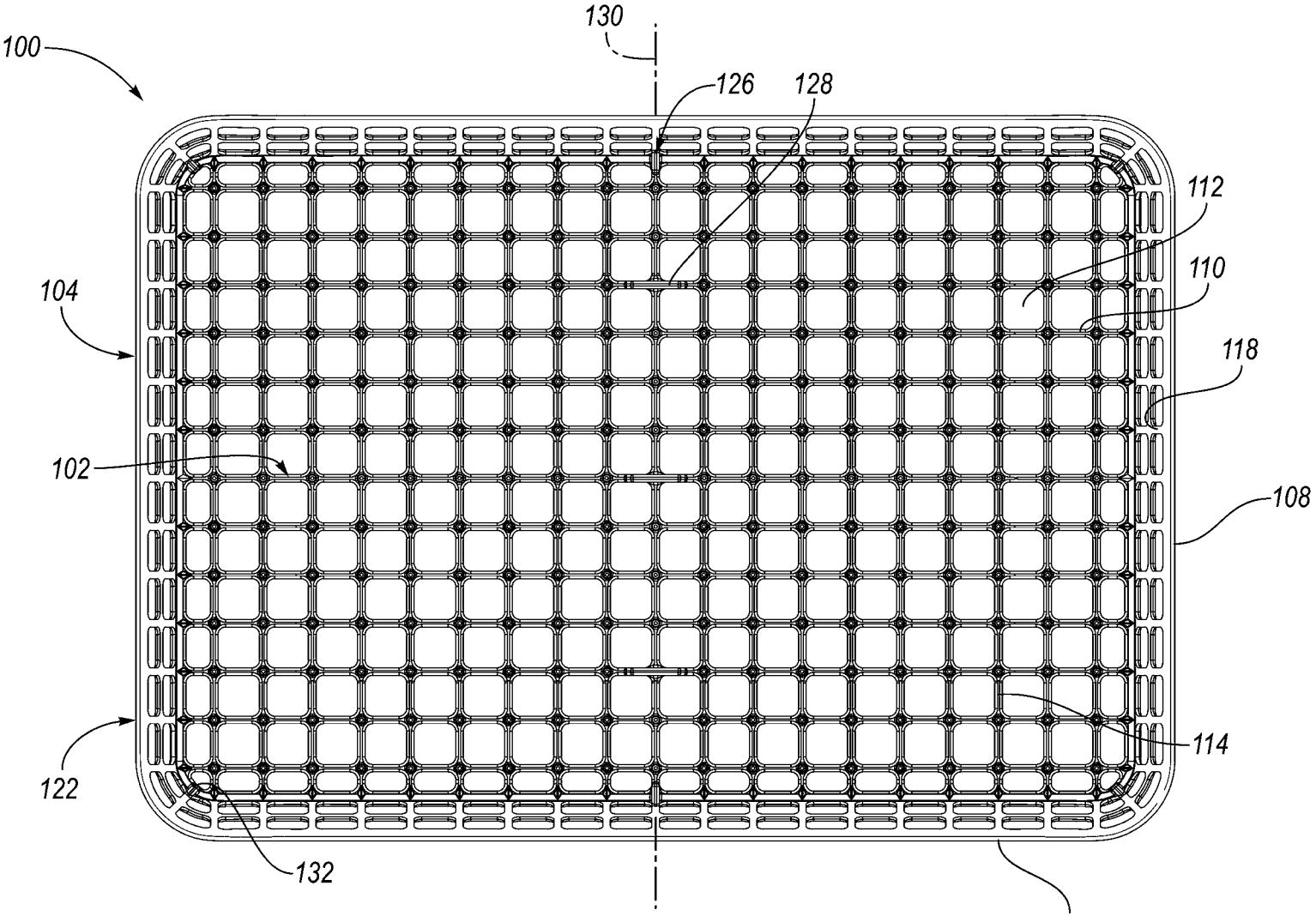
FIG. 3 is a top view of the bakery tray.
Figure 4:
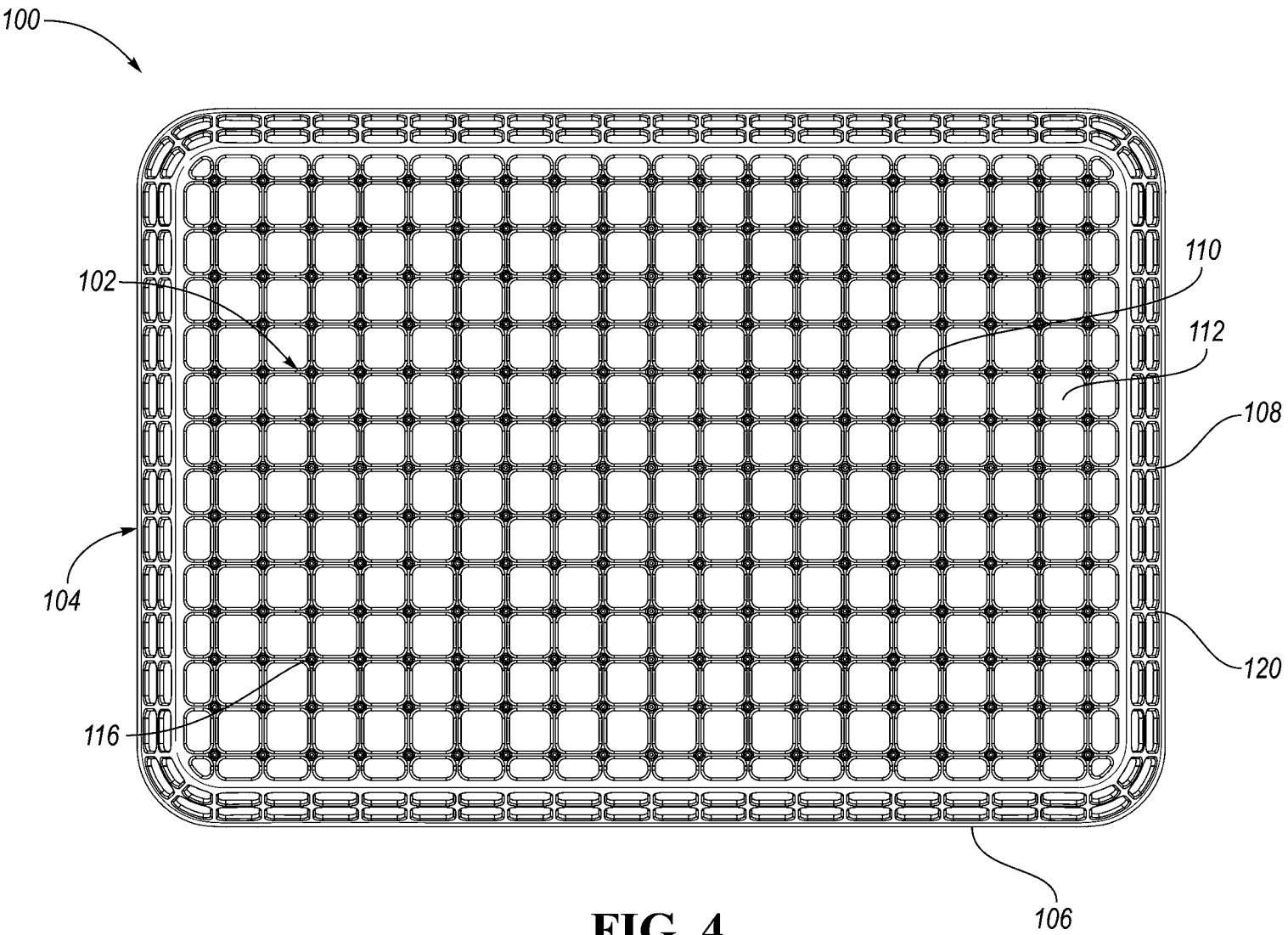
FIG. 4 is a bottom view of the bakery tray.
Figure 5:
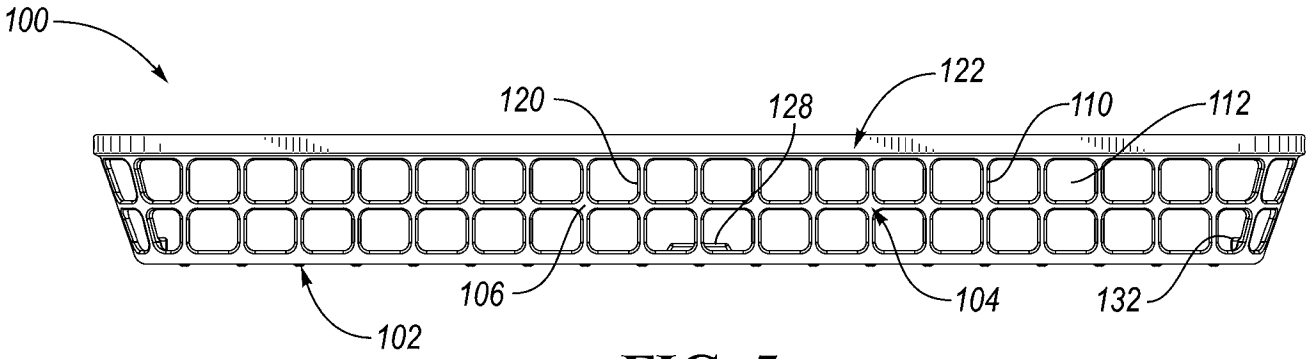
FIG. 5 is a side view of the bakery tray.
Figure 6:
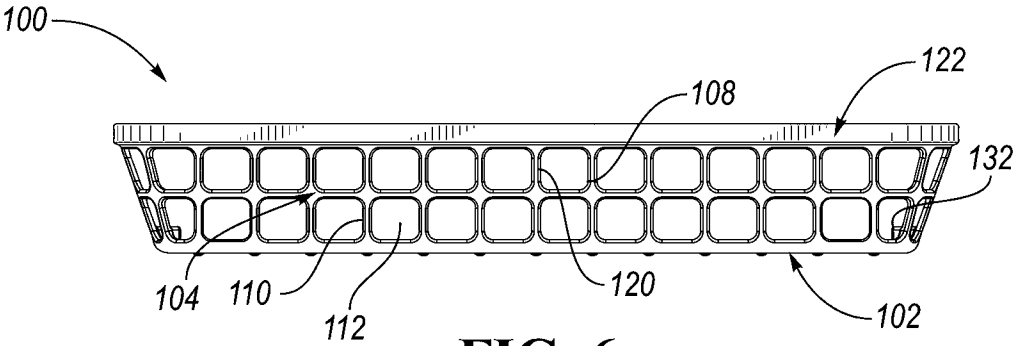
FIG. 6 is an end view of the bakery tray.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is understood that directional terms as noted herein (e.g., upper, lower, top, bottom, vertical, horizontal, downwardly, upwardly, etc.) simply refer to the orientation of various elements as illustrated in the accompanying figures and the manner in which elements may be oriented relative to each other. Such terms are provided for context and understanding of the embodiments disclosed herein and are not intended to be limiting.

With reference first to FIGS. 1-6, a bakery tray 100 for storing, displaying, and/or transporting perishable and delicate finished baked goods (for example, but not limited to, doughnuts, pastries, Danish, bagels, pretzels and/or cookies), is depicted according to one or more embodiments. The bakery tray 100 is configured to fit a variety of display, transportation, distribution, retail-ready, staging, and cooling racks, cabinets, and retail displays of all types.

In the embodiments disclosed herein, the bakery tray 100 is constructed (e.g. injection-molded) from a plastic material such that it is durable, washable, reusable, and recyclable, such that the bakery tray 100 helps create a safer, lighter weight, more cost-effective, and sustainable baked goods supply chain. Plastic trays are lighter than metal trays, which can be advantageous for ease of handling, transportation, and reducing the overall weight of bakery displays or storage. Plastic trays may also have a lower up-front cost compared with metal trays, and plastic trays have smooth surfaces that are easy to clean. The bakery tray 100 disclosed herein is easily recyclable at the end of its useful life cycle and, unlike conventional metal wire bakery trays, does not corrode and is 100% rust-free and galvanized flake-free, thus preventing the contamination of baked goods disposed therein. Also unlike conventional metal wire bakery trays, the plastic construction of the bakery tray 100 prevents injuries due to cuts, scrapes, or puncture wounds during handling. Still further, reusable plastic offers a lower carbon footprint and a higher sustainability score than conventional metal alternatives.

In one or more embodiments, the bakery tray 100 is constructed from 100% virgin or recycled plastic resin or resin blend such as, but not limited to, HDPE (high density polyethylene) or PP (polypropylene) resin. The bakery tray 100 is composed of FDA-approved resins, colors, and additives, and may include FDA-approved color/coding options. Advantageously, the bakery tray 100 can be manufactured in a wide range of colors, allowing for customization or branding. In one non-limiting example, the bakery tray 100 may have an operational temperature range of approximately −10° F. to 165° F.

With continuing reference to FIGS. 1-6, the bakery tray 100 includes a base 102 and a wall structure 104 integrally formed with the base 102 from a plastic material, the wall structure 104 extending around and upwardly from a periphery of the base 102. In one or more embodiments, the wall structure 104 includes two opposed side walls 106 joined to two opposed end walls 108. As shown, the side walls 106 may have a longer length than a length of the end walls 108, such that the bakery tray 100 has a rectangular configuration as illustrated herein. In one non-limiting example, the bakery tray 100 may have dimensions of 26 inches in length and 18 inches in width (outer diameter), but it is understood that other dimensions are possible. Various length and width dimensions of the bakery tray 100 are contemplated based on the particular baked good product, application, rack compatibility, automation, processing equipment, and customer-specific supply chain variables.

As shown, in one or more embodiments, the base 102 and the wall structure 104 have a perforated, mesh, grid or lattice configuration of longitudinal and transverse struts 110. In one non-limiting example, the longitudinal and transverse struts 110 define openings 112 with dimensions of approximately 1 inch×1 inch (1 in2) in area, although the openings 112 are not limited to this size or shape. In one or more embodiments, the size of the openings 112 may be optimized based on the following factors: maximizing strength, minimizing weight, and minimizing surface area for water collection. The mesh configuration of the base 102 and the wall structure 104 advantageously provides a lightweight bakery tray 100, requires less material for construction and thus is cost effective, allows any unwanted liquids to drain through the base 102 and the wall structure 104 such that the bakery tray 100 may be easily cleaned and dried, and facilitates air flow and cooling.

The base 102 includes a top surface 114 and an opposed bottom surface 116, and the wall structure 104 includes an inner surface 118 and an outer surface 120, all of which may be generally flat or may be radiused to prevent any solid or liquid accumulation during the washing, rinsing and drying process of the bakery tray 100. The wall structure 104 may be angled to flare slightly outwardly from the base 102 to allow for empty nesting of bakery trays 100 as described further below.

The inner surface 118 of the wall structure 104 may be rounded adjacent the corners of the bakery tray 100 (intersection of the side walls 106 and the end walls 108). An upper rim 122 is provided at a top edge 124 of the wall structure 104, wherein the upper rim 122 provides additional support, rigidity, and product containment for the bakery tray 100. With the wall structure 104 flaring outwardly from the base 102, a perimeter of the upper rim 122 is larger than a perimeter of the base 102. The upper rim 122 may have a solid configuration, and may be suitable for optional branding or logo placement. It is also contemplated that the bakery tray 100 could optionally include RFID or bar code technology.

In one or more embodiments, the upper rim 122 has a uniform height above the base 102. In one non-limiting example, a height of the wall structure 104 from the base 102 to the upper rim 122 is between about 2.5 inches and about 3 inches, but it is understood that other dimensions are possible. As with the length and width dimensions, various height dimensions of the bakery tray 100 are contemplated based on the particular baked good product, application, rack compatibility, automation, processing equipment, and customer-specific supply chain variables.

Figure 7:
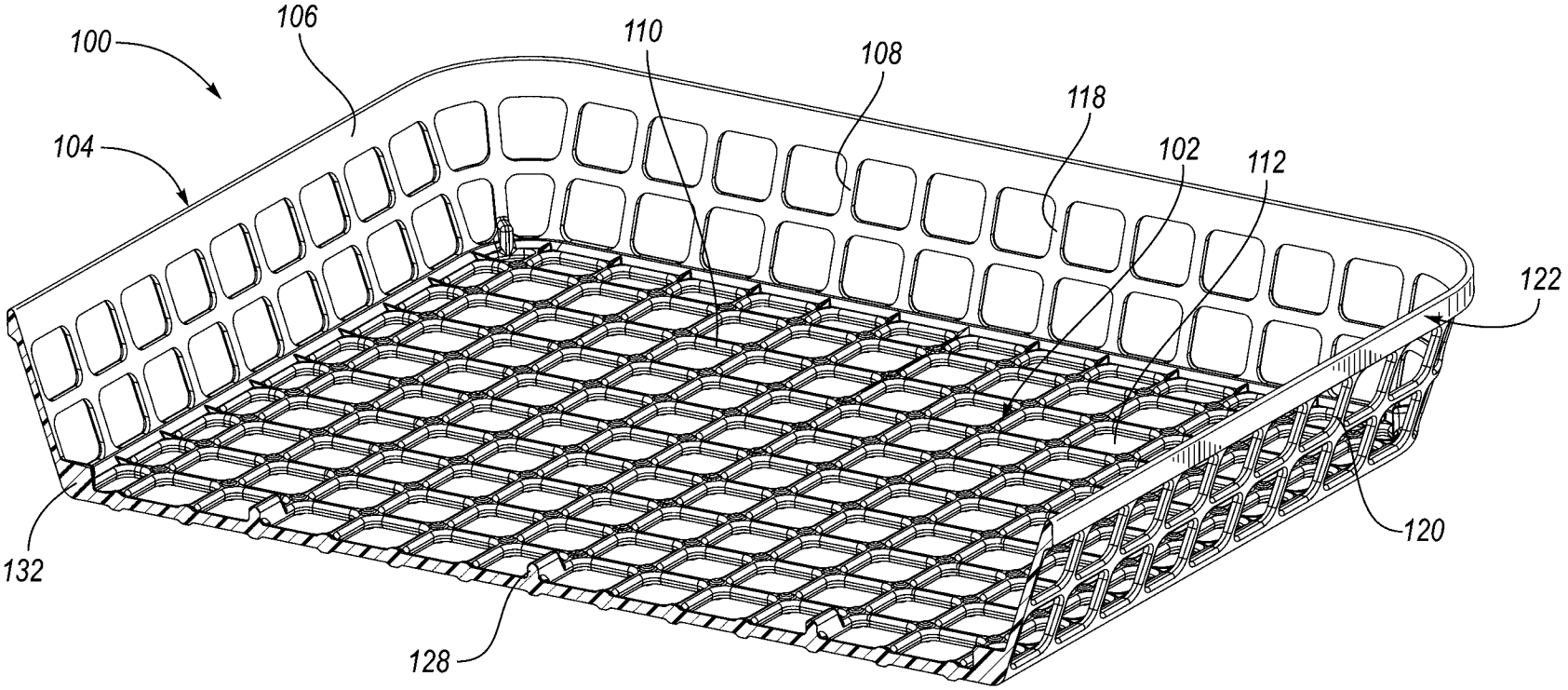
FIG. 7 is a top perspective, cross-sectional view of the bakery tray.
Figure 8:
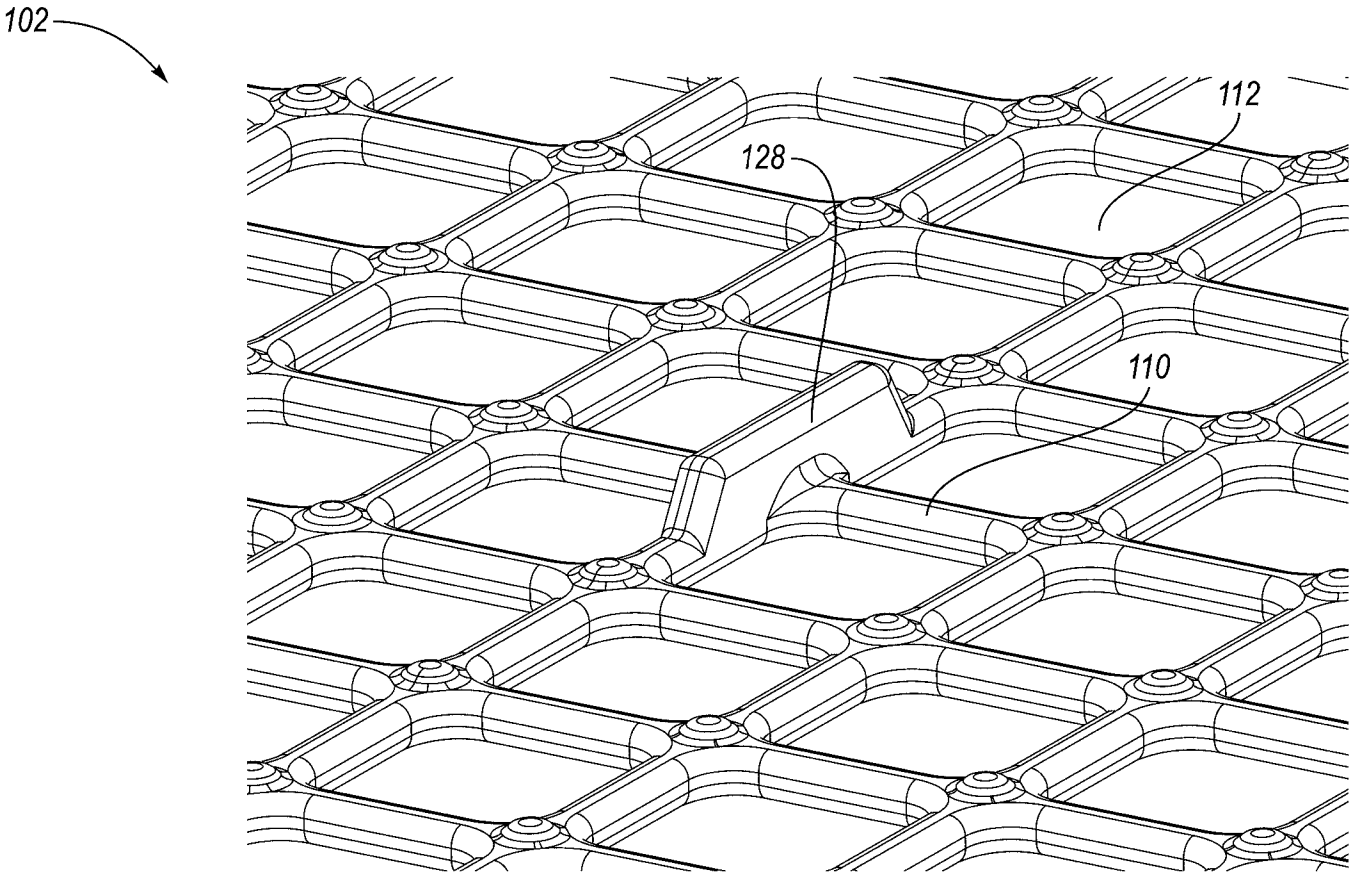
FIG. 8 is an enlarged view of a base of the bakery tray and a nesting tab.

With reference now to FIGS. 1, 7 and 8, the top surface 114 of the base 102 may include a plurality of nesting tabs 126 extending upwardly therefrom which are configured to support an upper bakery tray **100*b* at a desired height during empty nesting of a lower bakery tray 100*a* and an upper bakery tray 100*b* as described below. In one or more embodiments, the plurality of nesting tabs 126 may include one or more (e.g. three) central tabs 128 projecting upwardly from the base 102 and which are spaced along a central transverse axis 130 of the bakery tray 100. The plurality of nesting tabs 126 may also include edge tabs 132 projecting upwardly from the base 102 at each corner of the bakery tray 100 and at each end of the central transverse axis 130**.

In one non-limiting embodiment, the edge tabs 132 may be generally rectangular. As best shown in the cross-sectional view of FIG. 7 and the enlarged view of FIG. 8, the central tabs 128 may have a generally trapezoidal configuration which extends between two longitudinal struts 110, bridging a transverse strut 110, but are not limited to this shape or arrangement. In one non-limiting embodiment, the nesting tabs 126 (the central tabs 128 and the edge tabs 132) may have a height of between about 0.35 to about 0.4 inches above the top surface 114 of the base 102. Of course, other heights of the nesting tabs 126 are fully contemplated.

Figure 9:
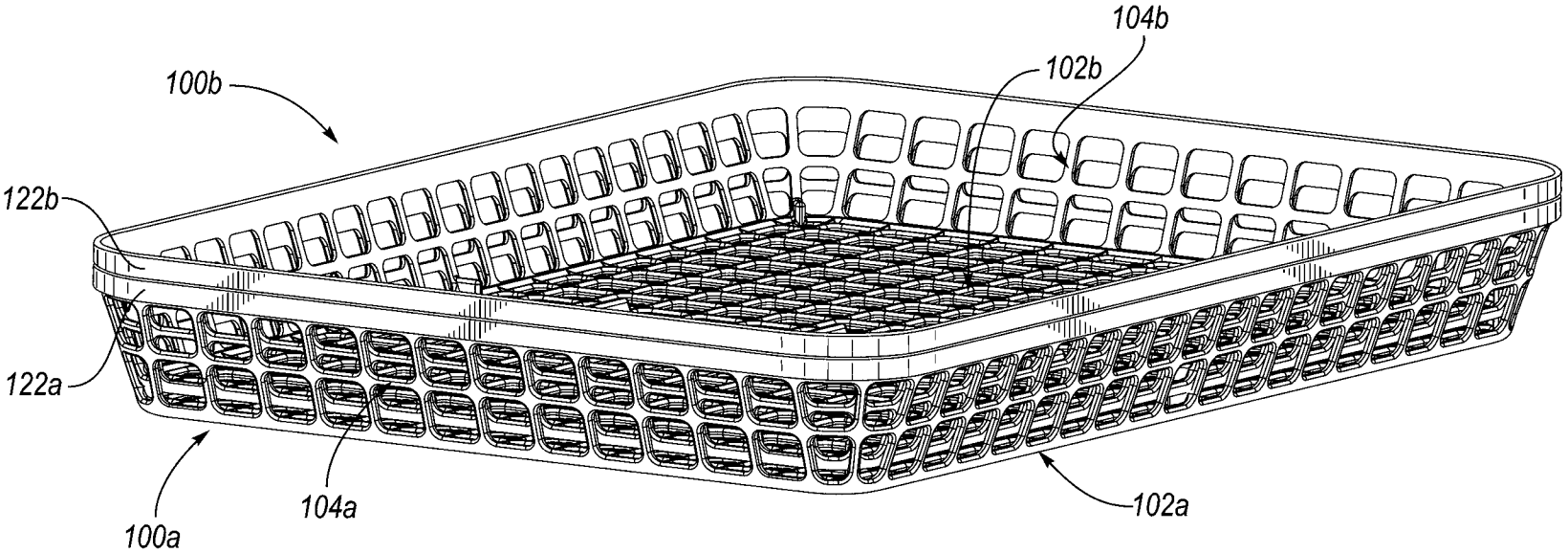
FIG. 9 is a top perspective view of a first bakery tray and a second bakery tray in an empty nesting configuration.
Figure 10:
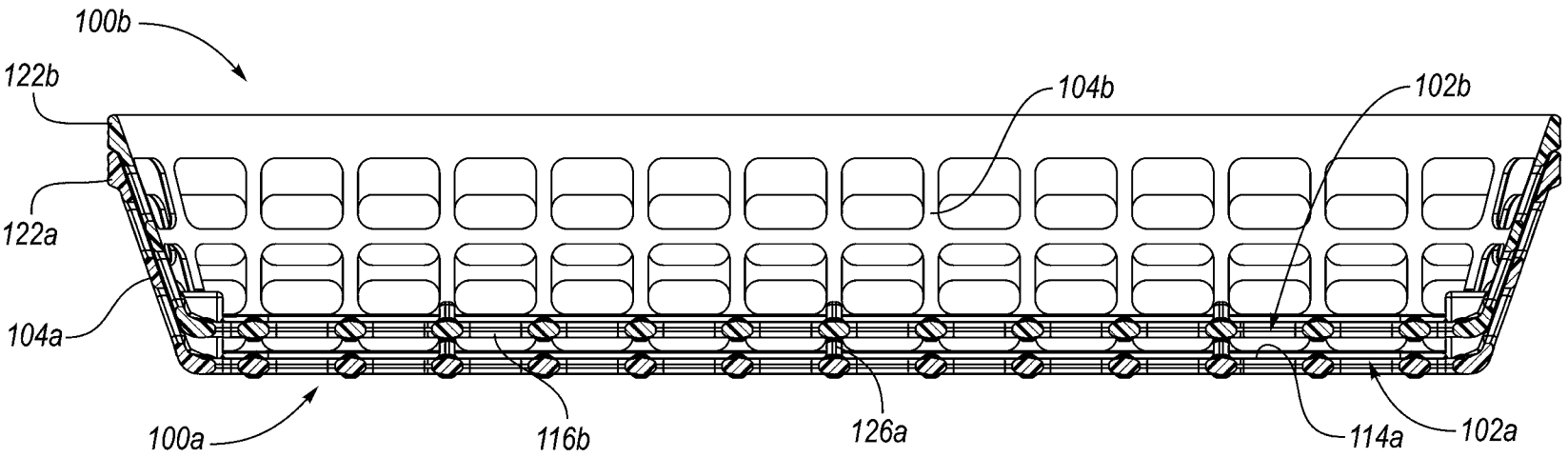
FIG. 10 is a side view of the first bakery tray and the second bakery tray in an empty nesting configuration.

As mentioned above, the bakery tray 100 is nestable with other like trays when empty, such as for conserving storage space. FIGS. 9 and 10 depict a system of nesting trays including a first, lower bakery tray 100*a* with a second, upper bakery tray 100*b* nested therein. The first bakery tray 100*a* includes a first base 102*a* including a top surface 114*a*, the top surface 114*a* including a plurality of nesting tabs 126*a* extending upwardly therefrom, and a first wall structure 104*a* extending upwardly from a periphery of the first base 102*a*. The second bakery tray 100*b* includes a second base 102*b* including a bottom surface 116*b*, and a second wall structure 104*b* extending upwardly from a periphery of the second base 102*b*.

During nesting, the second bakery tray 100*b* is configured to be nested within the first bakery tray 100*a* with the plurality of nesting tabs 126*a* of the first bakery tray 100*a* supporting the bottom surface 116*b* of the second bakery tray 100*b* such that the upper rim 122*b* of the second bakery tray 100*b* is disposed above the upper rim 122*a* of the first bakery tray 100*a*. More particularly, the bottom surface 116*b* of the second base 102*b* of the second bakery tray 100*b* is arranged to abut and rest upon the nesting tabs 126*a* of the first bakery tray 100*a*, with the wall structure 104*b* of the second bakery tray 100*b* abutting the wall structure 104*a* of the first bakery tray 100*a*. The nesting tabs 126*a* prevent the first bakery tray 100*a* and the second bakery tray 100*b* from sticking together when nested, and leave the upper rim 122*b* of the second bakery tray 100*b* exposed. In this way, the upper rim 122*b* of the second bakery tray 100*b* can be easily grasped when the first bakery tray 100*a* and the second bakery tray 100*b* are to be separated. The minimal height of the nesting tabs 126*a* allows for a very compact nesting system for optimal storage efficiency.

Figure 11:
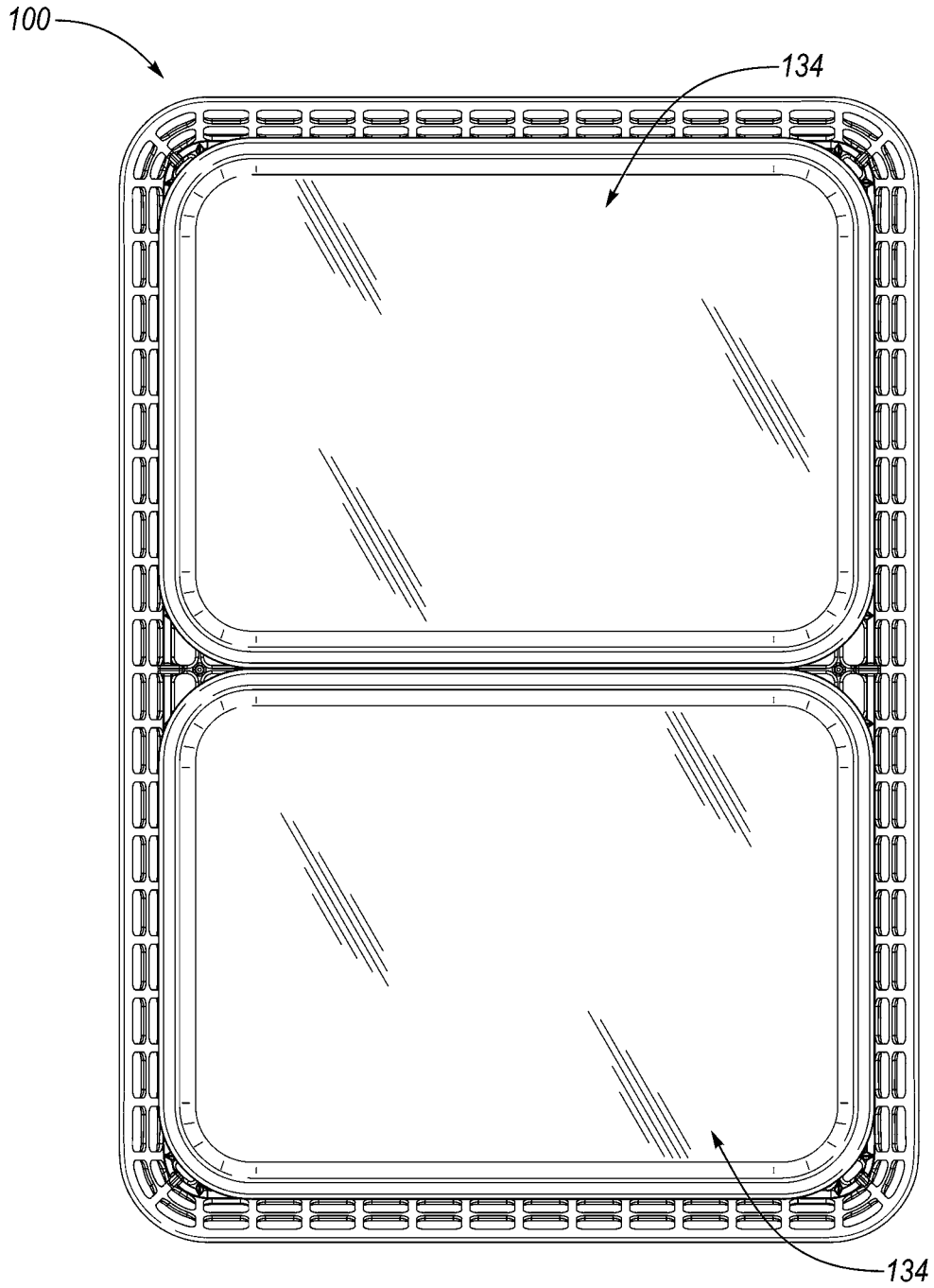
FIG. 11 is a top view of two auxiliary trays loaded in the bakery tray.
Figure 12:
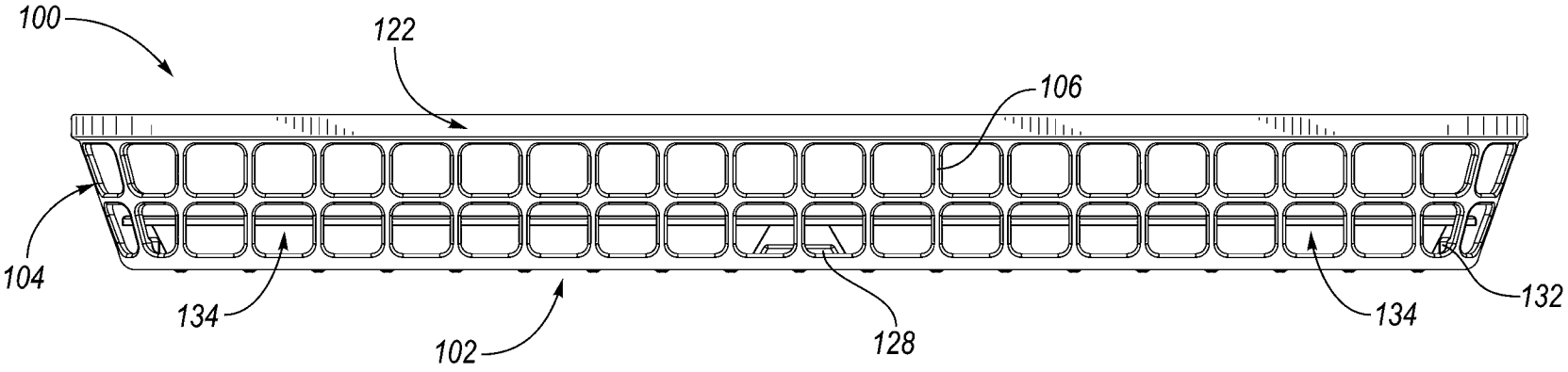
FIG. 12 is a side view of two auxiliary trays loaded in the bakery tray.
Figure 13:
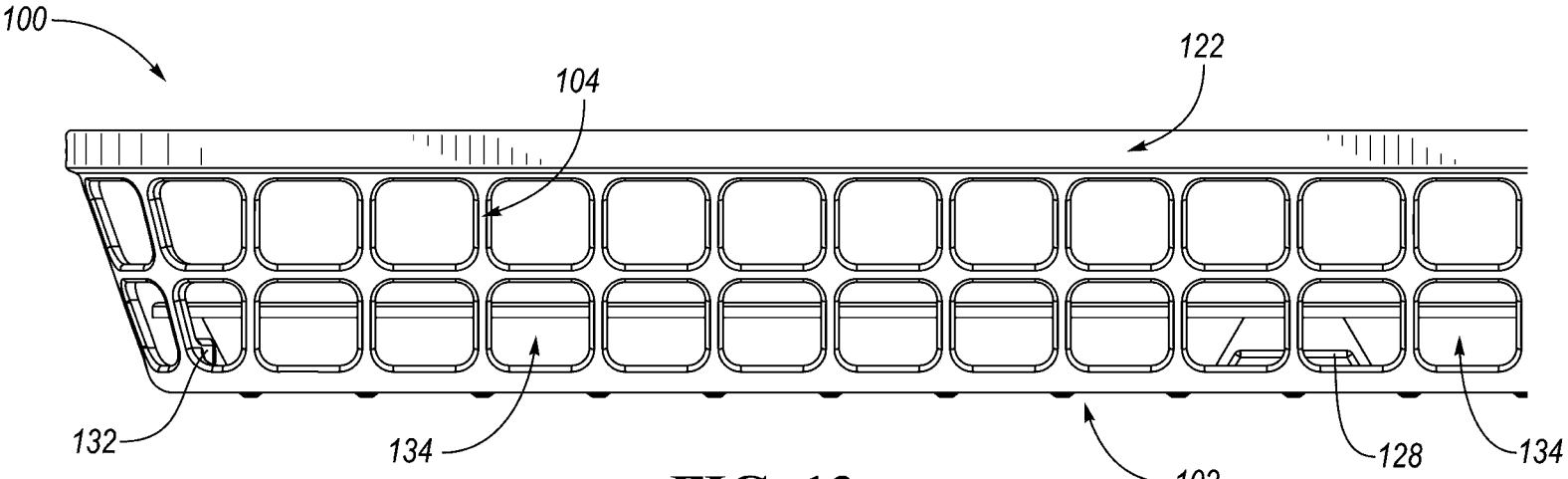
FIG. 13 is an enlarged, partial side view of auxiliary trays loaded in the bakery tray.

As shown in FIGS. 11-13, the bakery tray 100 is designed to accommodate one or more auxiliary trays 134 loaded therein, wherein baked goods may be disposed on the auxiliary trays 134. In the exemplary embodiment shown, the bakery tray 100 may be configured to hold two adjacent auxiliary trays 134 placed on the base 102 along the longitudinal dimension of the bakery tray 100. Advantageously, the nesting tabs 126 (the central tabs 128 and the edge tabs 132) act as locating features for aligning and separating the auxiliary trays 134 and preventing unwanted movement of the auxiliary trays 134 along the base 102.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A bakery tray, comprising:

a generally rectangular base including a top surface and a bottom surface, the top surface including a plurality of nesting tabs extending upwardly therefrom including central tabs projecting upwardly along a central transverse axis of the base, and edge tabs projecting upwardly from the base at each corner of the bakery tray and at each end of the central transverse axis; and a wall structure extending upwardly from a periphery of the base and including an inner surface and an outer surface, the wall structure including an upper rim having a uniform height above the base, wherein the wall structure flares outwardly from the base such that a perimeter of the upper rim is larger than a perimeter of the base, an entirety of the wall structure having a mesh configuration including longitudinal and transverse struts which define openings;

wherein the base and the wall structure are integrally formed from a plastic material and wherein the plurality of nesting tabs are configured to support another bakery tray nested within the bakery tray.

2. The bakery tray of claim 1, wherein the top surface, the bottom surface, the inner surface, and the outer surface each have a radiused configuration.

3. The bakery tray of claim 1, wherein the inner surface of the wall structure is rounded adjacent to corners of the bakery tray.

4. The bakery tray of claim 1, wherein the plurality of nesting tabs each have a height of between about 0.35 to about 0.4 inches above the base.

5. The bakery tray of claim 1, wherein a height of the wall structure from the base to the upper rim is between about 2.5 inches and about 3 inches.

6. The bakery tray of claim 1, wherein each opening has an area of approximately 1 $in^2$.

* * * * *